US006237238B1

(12) United States Patent
Shapiro

(10) Patent No.: US 6,237,238 B1
(45) Date of Patent: May 29, 2001

(54) ANGLE MEASUREMENT TOOL

(76) Inventor: Marc Lev Shapiro, 1931 Martha's Rd., Alex., VA (US) 22307

( * ) Notice: Subject to any disclaimer, the term of this patent is extended or adjusted under 35 U.S.C. 154(b) by 0 days.

(21) Appl. No.: 09/393,882

(22) Filed: Sep. 10, 1999

(51) Int. Cl.[7] ..... B43L 7/10
(52) U.S. Cl. ..... 33/471; 33/495; 33/534
(58) Field of Search ..... 33/471, 465, 495–500, 33/534, 418, 420, 421, 422, 424, 452, 456, 459, 468, 469, 472

(56) References Cited

U.S. PATENT DOCUMENTS

| | | | | |
|---|---|---|---|---|
| 597,464 | | 1/1898 | Girton . | |
| 832,483 | | 10/1906 | Johnson . | |
| 840,628 | | 1/1907 | Johnson . | |
| 1,125,770 | * | 1/1915 | Turgeon | 33/497 |
| 1,299,978 | | 4/1919 | MacDowney . | |
| 1,341,435 | * | 5/1920 | Olsen | 33/495 |
| 1,351,527 | * | 8/1920 | Lopez | 33/499 |
| 1,585,563 | | 5/1926 | Schlattow . | |
| 1,599,776 | * | 9/1926 | Lazarevich | 33/468 |
| 4,920,658 | * | 5/1990 | Hile | 33/465 |
| 5,117,560 | | 6/1992 | Nevins . | |
| 5,392,525 | | 2/1995 | Chow . | |
| 5,687,628 | * | 11/1997 | Liao | 33/500 |

FOREIGN PATENT DOCUMENTS

| | | | | |
|---|---|---|---|---|
| 473356 | * | 5/1951 | (CA) | 33/471 |
| 2741978 | * | 3/1979 | (DE) | 33/471 |
| 703754 | * | 2/1954 | (GB) | 33/469 |
| 2101342 | * | 1/1983 | (GB) | 33/471 |

* cited by examiner

*Primary Examiner*—Andrew H. Hirshfeld
(74) *Attorney, Agent, or Firm*—Herman Hohauser

(57) ABSTRACT

An angle measurement tool in which the assembled components result in only two moving parts that are pivoted relative to each other and wherein the pivot axis is the geographic center of the angle measurement component and wherein a miter joint angle, the correspondent actual angle, the complementary angle of the actual angle and the supplementary angle of the actual angle can be read simultaneously.

5 Claims, 4 Drawing Sheets

12
34
X
12

34

12
34

X
Y
14
14
13
36

30
24
22
14

16
16

16

28
X
18
18
28
32

26
28
22

18
20

PROTRACTOR
SUPPLEMENTARY
COMPLEMENTARY
BOTTOM
12
13
14
16
18
20
22
24
26
28
30
32
34
36
38
40
42

13
12
18
14
SUPPLEMENTARY
SUPPLEMENTARY
COMPLEMENTARY
42
40

12
13
14
18
PROTRACTOR
SUPPLEMENTARY
COMPLEMENTARY
COMPLEMENTARY
38
40

ANGLE MEASUREMENT TOOL

BACKGROUND OF THE INVENTION

This invention has to do with a measuring tool for use in the construction profession with particular applicability to finish carpentry, piping layouts, floor and ceiling installations and cabinetry. It also has direct applications in the graphic arts field, the engineering and drafting fields and other manufacturing situations where angle measurements are performed.

This invention is used in the fitting of trim and decorative pieces to the surface of wall surfaces which meet at an angular junction commonly referred to as a miter joint. A miter saw/miter box is used to cut the trim and decorative pieces in a precise manner so that a clean and accurate miter joint is established. Without an adequate tool the craftsman must eyeball the setting of the miter saw.

BRIEF SUMMARY OF THE INVENTION

It is an object of this invention to provide an easy to use tool to transfer angle readings from a work place surface to a miter saw in a one-step operation.

It is a further object of this invention to measure an angle, its complementary angle and its supplementary angle simultaneously.

In the preferred embodiment of the invention an angle measurement tool is provided that in its final form is limited to two parts. One of the parts has a plurality of scale measurements scribed upon it. The tool is so constructed that the movement of the two parts relative to each other will result in an angle being formed there between that will be measured by referring to a setting on the scale so provided.

The tool can be utilized to measure the miter joint angle the actual angle made by the legs of the tool, the complementary angle of the actual angle and the supplementary angle of the actual angle simultaneously.

BRIEF DESCRIPTION OF THE DRAWINGS

FIG. 1 is a plan view of the dial 12.

FIG. 2 is a plan view of top leg 14.

FIG. 3 is a plan view of the O-ring 16

FIG. 4 is a plan view of bottom leg 18.

FIG. 10 is an exploded view of the tool showing how the components interrelate.

DETAILED DESCRIPTION OF THE INVENTION

Figures 1A, 1B, 1C, 2A, 2B, 2C, 3A, 3B, 3C, 4A, 4B, 4C, 5:
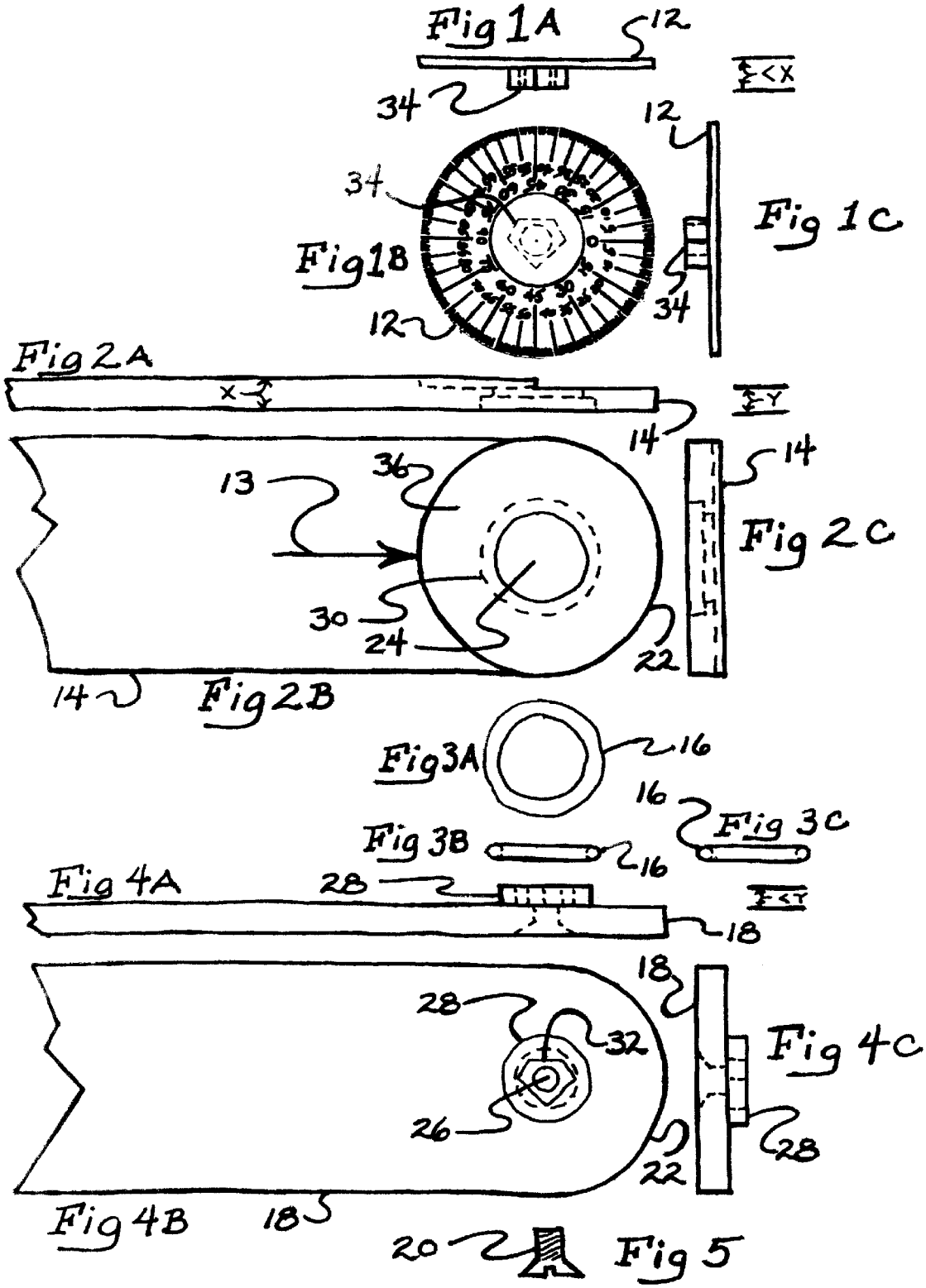
FIG. 5 is a plan view of bolt 20.
Figure 6:
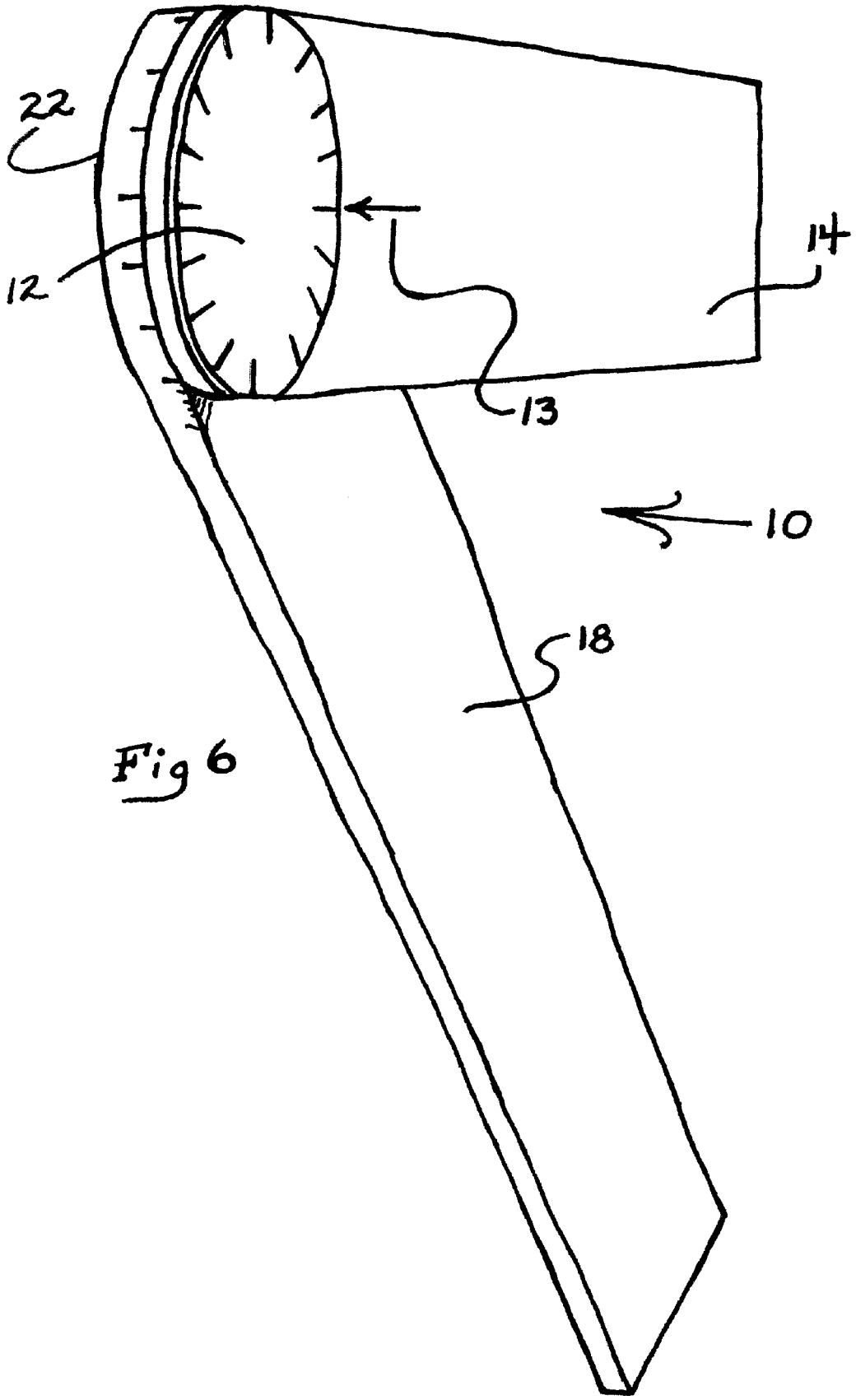
FIG. 6 is a perspective view of all of the components as assembled with the legs forming an acute angle.
Figures 7, 8, 9, 10A, 10B:
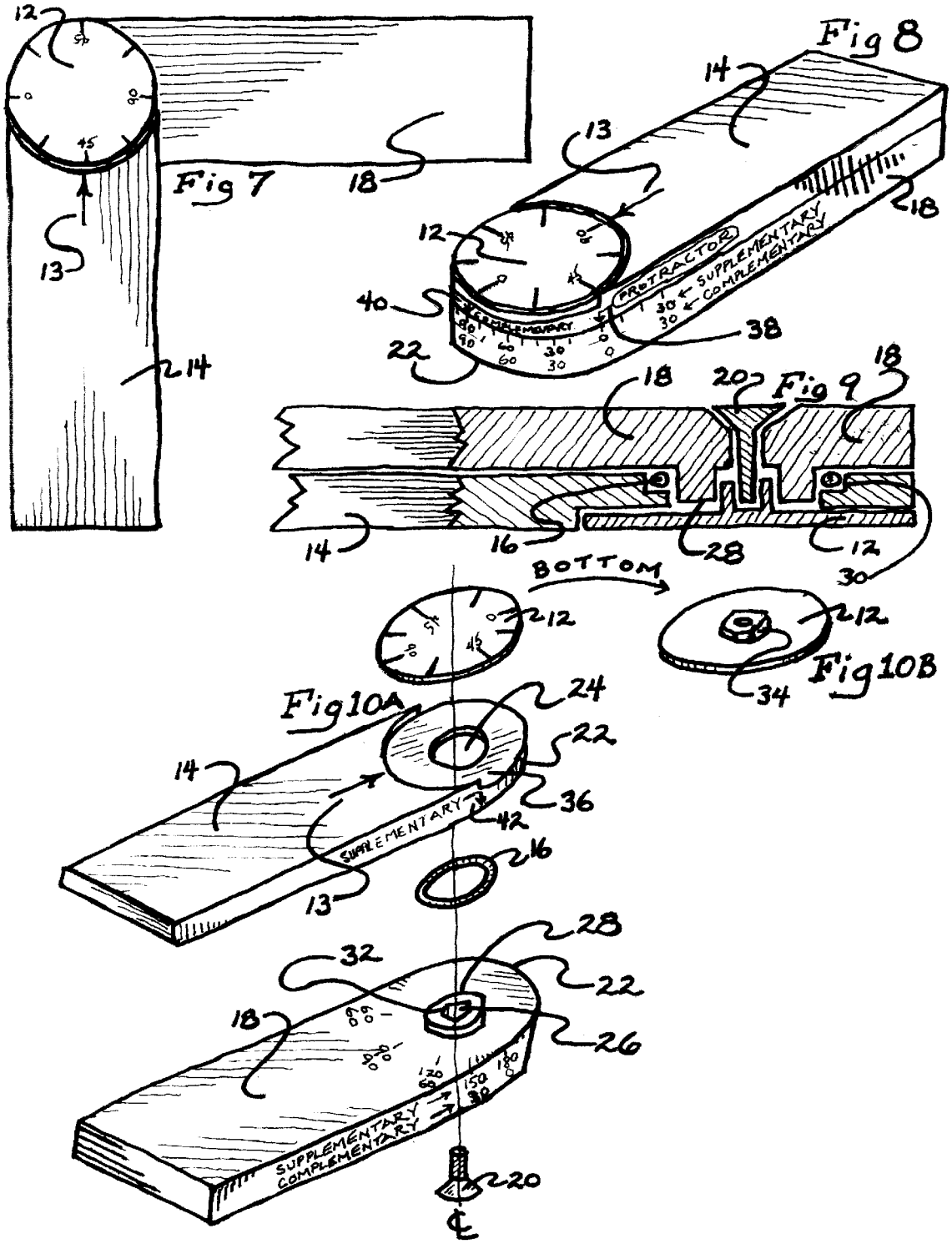
FIG. 7 is a top view of the tool.
FIG. 8 is a perspective view of the tool in a closed position.
FIG. 9 is a side cut-away view of the tool.

As can be seen in FIGS. the preferred embodiment of angle measurement tool 10 is constructed from several components including dial 12, top leg 14, O-ring 16, bottom leg 18 and bolt 20. Legs 14 and 18 are the same width and both have a circular shaped end 22. It should be understood that circular end 22 of both leg 14 and leg 18 is a semicircle of a circle having a diameter equal to the width of leg 14 and leg 18. Openings 24 and 26 in legs 14 and 18 respectively, are provided at the center of the circle of which ends 22 are a part. Dial 12 is circular in shape and has a diameter equal to the width of legs 14 and 18 as shown in the drawings. It should be understood that dial 12 could have a diameter less that the width of legs 14 and 18 and further, does not have to be in the shape of a circle in order for tool 10 to operate in the fashion described. Support 28 is permanently affixed to leg 18 around the perimeter of hole 26 as shown. The interior circumference of support 28 has a non-circular shape for reasons that will be apparent below. When the components of tool 10 are assembled O-ring 16 is placed over and around the outer circumference of support 28. Leg 14 is positioned over leg 18 so that the recessed opening 30 in leg 14 fits over support 28 and O-ring 16. Bolt 20 is then used to tighten and compress O-ring 16 between leg 14 and leg 18. The presence of O-ring 16 provides a frictional force between legs 14 and 18 that maintains dial 12 in a steady position for an accurate reading of the measured angle. It should be understood that O-ring 16 may not be necessary in all applications. Other position adjustment mechanisms are contemplated in alternative embodiments of the invention.

Leg 18 is provided with a positionally unique indexing socket 32 formed in the center of support 28. In the preferred embodiment a projection 34 having the same shape as indexing socket 32 is provided on the bottom surface of dial 12 as shown in the drawing. When the components are assembled projection 34 fits snugly in socket 32 so that dial 12 and leg 18 never move in relation to each other.

Leg 14 is also provided with a flat recess 36 on the top surface thereof which results in the top surface of dial 12 being coplanar with the top surface of leg 14 after the components of tool 10 are assembled. It should be understood that the top surface of dial 12 does not have to be co-planer with the top surface of leg 14. Countersunk flathead bolt 20 is passed through the bottom of leg 18 into locking threads in the center of extension 34 on the bottom of dial 12 resulting in legs 14 and 18 compressing O-ring 16 in a sandwich-like manner. This provides precisely pivoting legs 14 and 18 with a friction adjustment. In the use of tool 10 no further friction adjustment is necessary. It is recognized that leg 14 is the only moving part of the tool 10 when being used to measure an angle for a miter joint reading.

Figure 11:
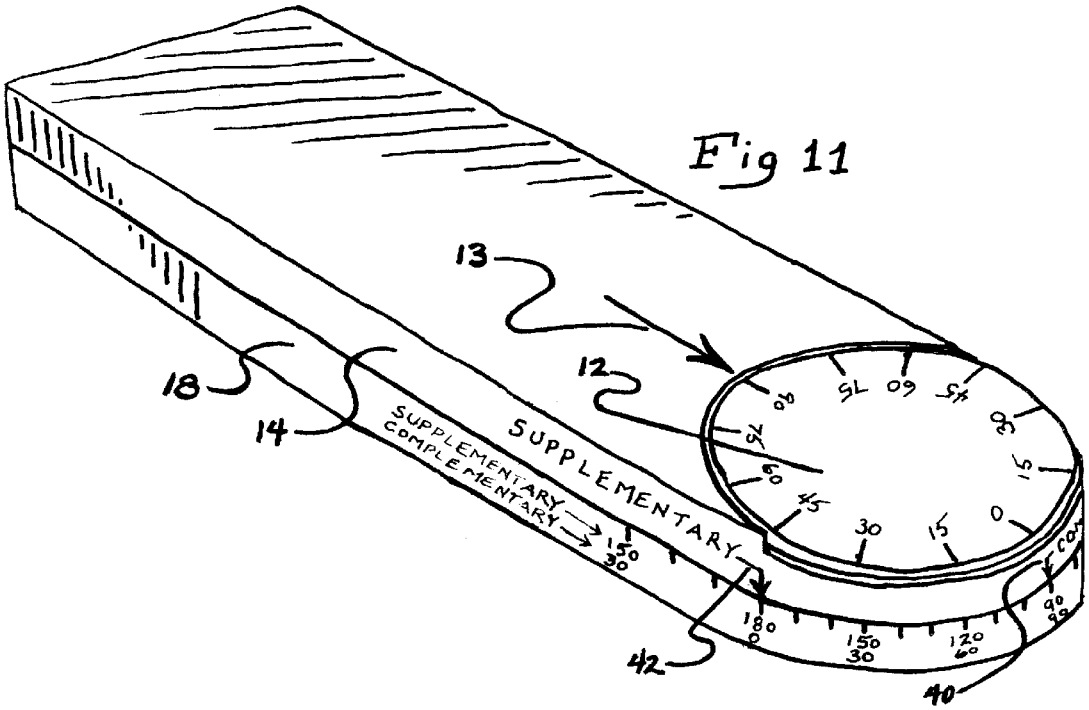
FIG. 11 is a perspective view of the tool in a closed position.
Figure 12:
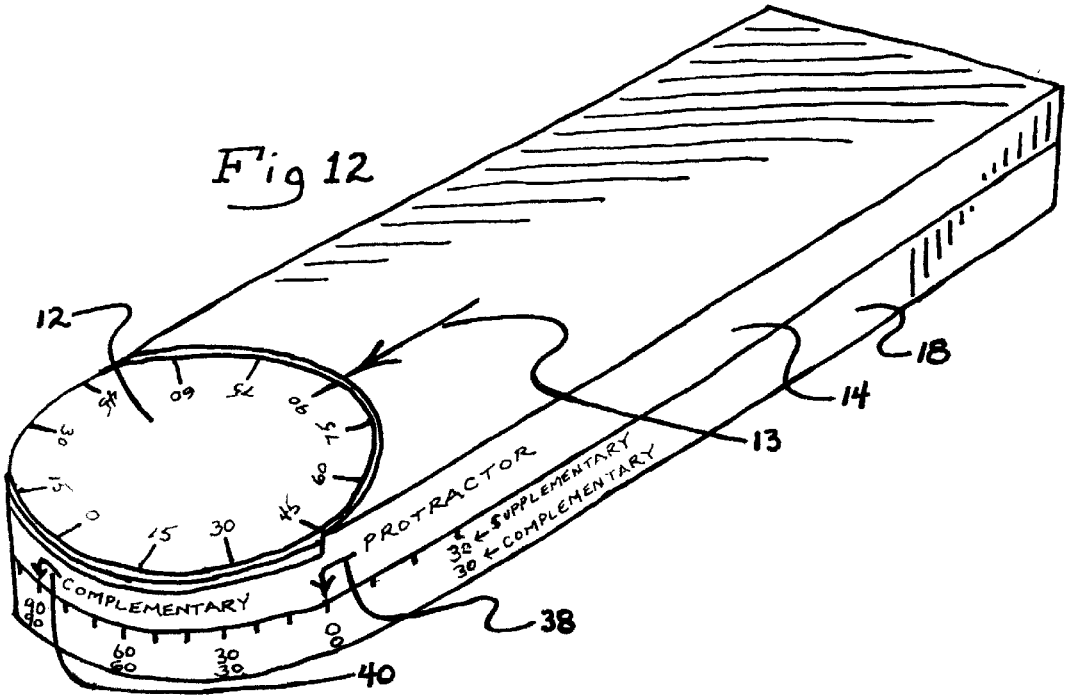
FIG. 12 is a perspective view of the tool in a closed position.

Arrow 13 is provided on the top surface of leg 14 as shown in the figures. Arrows 38, 40 and 42 are provided on the radial surface of leg 14 as shown in FIGS. 11 and 12.

In operation tool 10 simultaneously provides the miter joint angle measurement, the actual angle made by the legs 14 and 18, the complementary angle measurement of the actual angle and the supplementary angle measurement of the actual angle. In the preferred embodiment dial 12 is provided with indexing markings that are representative of the miter joint angle reading. Specifically arrow 13 points to the marking on dial 12 that is the miter joint reading. The indexing provided on the radial surface of leg 18 measures the actual angle reading via arrow 38; the complementary angle reading via arrow 40 and the supplementary angle reading via arrow 42. Referring to FIGS. 11 and 12 it is noted that the indexing markings representing the complementary angles readings are located on the bottom row of numbers printed on the radial surface of leg 18 and the supplementary angle readings are located on the top row of numbers.

Although specific embodiments of the invention have been described it should be recognized that additional modification and other alternative embodiments may be apparent by those skilled in the art. It is intended that the invention be defined solely by the following claims

I claim:

1. An angle measurement tool comprising:

a first member having top and bottom surfaces, a second member having top and bottom surfaces, said first and second members being connected at a pivot location such that said top surface of said first member abuts said bottom surface of said second member, first means comprising an indicia bearing member and a connection means for connecting said indicia bearing member to said first member, said connection means comprising a first projection on the first member, wherein said second member is rotatably secured to the exterior of said first projection, said connection means further comprising a socket in the first projection and a second projection on the indicia bearing member, said second projection having a non-circular cross section and said socket having a non-circular cross section matching said cross section of said second projection, wherein said second projection fits into said socket to non-rotatably secure said indicia bearing member to said first member, said first means having a top surface on said indicia bearing member, second means located on said top surface of said second member, said first means passing through said second member so that said top surface of said first means is located nearer to said top surface of said second member than said bottom surface of said second member, wherein indicia on said top surface of said first means interacts with said second means to form angle measurement means so that the angle formed when said first member is moved relative to said second member can be determined.

2. The angle measurement tool of claim 1 wherein said first means is located in the same plane as said top surface of said second member.

3. The angle measurement tool of claim 1 wherein said first means passes through said second member at said pivot location.

4. The angle measurement means of claim 1 wherein said first means is located in the same plane as said top surface of said second member.

5. The angle measurement tool of claim 1 wherein said top surface of said first means is circular.

* * * * *